US010517418B2

(12) United States Patent
Wu

(10) Patent No.: US 10,517,418 B2
(45) Date of Patent: Dec. 31, 2019

(54) ASSEMBLING CURTAIN RAIL

(71) Applicant: Hangzhou Binthen Intelligent Technology Co., Ltd., Hangzhou (CN)

(72) Inventor: Zhonghua Wu, Hangzhou (CN)

(73) Assignee: HANGZHOU BINTHEN INTELLINGENT TECHNOLOGY CO., LTD., Hangzhou (CN)

( * ) Notice: Subject to any disclaimer, the term of this patent is extended or adjusted under 35 U.S.C. 154(b) by 0 days.

(21) Appl. No.: 15/964,008

(22) Filed: Apr. 26, 2018

(65) Prior Publication Data

US 2019/0075955 A1 Mar. 14, 2019

(30) Foreign Application Priority Data

Sep. 8, 2017 (CN) ..... 2017 1 0803365

(51) Int. Cl.

| | |
|---|---|
| ***A47H 1/08*** | (2006.01) |
| ***A47H 1/124*** | (2006.01) |
| *A47H 1/144* | (2006.01) |
| *A47H 1/04* | (2006.01) |

(52) U.S. Cl.

CPC ..... *A47H 1/08* (2013.01); *A47H 1/124* (2013.01); *A47H 1/144* (2013.01); *A47H 2001/047* (2013.01); *Y10T 16/354* (2015.01)

(58) Field of Classification Search

CPC ... Y10T 16/354; Y10T 16/373; Y10T 16/375; Y10T 16/376; Y10T 16/377; Y10T 16/378; Y10T 16/3785; Y10T 16/379; Y10T 16/3797; A47H 1/08; A47H 1/124; A47H 1/144; A47H 1/04; A47H 2001/047; A47H 2001/045

USPC .... 16/96 R, 96 D, 87.4 R, 94 R, 94 D, 95 R, 16/95 W, 95 D, 95 DW

See application file for complete search history.

(56) References Cited

U.S. PATENT DOCUMENTS

| | | | | | |
|---|---|---|---|---|---|
| 509,650 | A * | 11/1893 | Brodie | B65G 21/22 | 104/108 |
| 1,402,815 | A * | 1/1922 | Wait | A47H 1/08 | 403/52 |
| 1,494,430 | A * | 5/1924 | Kirsch | A47H 1/08 | 211/105.2 |
| 1,565,742 | A * | 12/1925 | Kenney | A47H 1/08 | 403/52 |
| 2,204,493 | A * | 6/1940 | Henry | A47H 1/08 | 211/105.3 |

(Continued)

*Primary Examiner* — Jeffrey O'Brien

(74) *Attorney, Agent, or Firm* — Schwegman Lundberg & Woessner, P.A.

(57) ABSTRACT

The present invention relates to an assembling curtain rail including at least two corresponding fast-assembling rails and a rail connection piece used for connecting the two fast-assembling rails. An upper end and a lower end of the two sides of the fast-assembling rails are connected with upper fixing plates and a lower fixing plate, respectively. An inner side wall of the lower fixing plates has a guiding recess, and the rail connection piece is provided with a guiding protruding block cooperating with the guiding recess correspondingly. The guiding protruding block is located in the lower guiding slot. Via the connection and cooperating between the guiding recess and the guiding protruding block, the connection of the curtain rail is more firm, stability is better, and the usage safety is ensured.

10 Claims, 3 Drawing Sheets

(56) References Cited

U.S. PATENT DOCUMENTS

| | | | | | |
|---|---|---|---|---|---|
| 2,757,804 | A * | 8/1956 | Sadwin | A47B 61/02 | 104/108 |
| 3,891,091 | A * | 6/1975 | Anderson | A47H 1/08 | 211/105.3 |
| 4,694,531 | A * | 9/1987 | Foy | A47H 1/144 | 104/111 |
| 4,821,370 | A * | 4/1989 | Magdars | A47H 1/04 | 16/94 D |
| 4,935,988 | A * | 6/1990 | Ford | A47H 1/02 | 16/87.4 R |
| 6,039,295 | A * | 3/2000 | de Beijer | A47H 1/144 | 160/178.1 R |
| 6,467,127 | B1 * | 10/2002 | Goldstein | A47H 1/022 | 16/87 R |
| 8,210,369 | B2 * | 7/2012 | Hibshman | A47H 1/08 | 211/105.1 |
| 8,756,760 | B2 * | 6/2014 | Ulbrich-Gasparevic | A47H 1/06 | 16/87.4 R |
| 10,085,582 | B2 * | 10/2018 | Zahner | A47H 1/14 | |
| 2008/0156951 | A1 * | 7/2008 | Lin | A47H 1/04 | 248/261 |
| 2016/0374496 | A1 * | 12/2016 | Marcinik | A47H 1/04 | 160/331 |

* cited by examiner

ASSEMBLING CURTAIN RAIL

CROSS-REFERENCE TO RELATED APPLICATIONS

This Non-provisional application claims priority under 35 U.S.C. § 119(a) on Patent Application No(s). 201710803365.1 filed in People's Republic of China on Sep. 8, 2017, the entire contents of which are hereby incorporated by reference.

BACKGROUND OF THE INVENTION

Field of the Invention

The present invention relates to a rail, and more particularly, to an assembling curtain rail.

Description of the Related Art

With the improvement of people's living standard, people began to pursue higher life quality, and the curtain with a conventional form cannot meet people's need. An electric curtain came into being, and opening and closing of the curtain can be achieved by just moving a finger, which saves time and effort. However, since most of the rails are integrally formed and the sizes are large, and the spaces of a residential corridor and an elevator are relative narrow, so the rail cannot be transported to the installation site successfully. There is also a way of hanging the rail from downstairs to upstairs, but the difficulty is large, and it is limited to the floor which is not high. At the same time, an existing connection of the assembling curtain rail is not strong enough, which brings a security risk.

In view of the above-mentioned problems, it is necessary to improve it.

BRIEF SUMMARY OF THE INVENTION

An objective of the present invention is to provide an assembling curtain rail, so as to reduce the size of a packing box, facilitate transportation of the rail, simplify An assembling way of the rail, facilitate the installation of the rail; and hide a protruding motor, beautify an overall appearance of the curtain, increase firmness of the connection of the assembling curtain rail at the same time, and ensure the usage safety.

To achieve above-mentioned objectives, the technical solution provided by the present invention is: An assembling curtain rail including at least two corresponding fast-assembling rails and a rail connection piece used for connecting the two fast-assembling rails. A groove with a downward opening for allowing a curtain sliding component to slide is formed at a middle part of the fast-assembling rails. Two sides of the fast-assembling rails are provided with connection slots, and connection blocks used for positioning and cooperating with the connection slots are disposed in the rail connection piece correspondingly. The rail connection piece is detachably connected with the fast-assembling rails. An upper end and a lower end of the two sides of the fast-assembling rails are respectively connected with upper fixing plates and lower fixing plate which are symmetrical relative to each other. The upper fixing plates and the lower fixing plates are L-shaped. Upper guiding slots and lower guiding slots which are symmetrical relative to each other are formed between a left end and a right end of an inner side wall of the rail connection piece and the connection block. The upper fixing plates and the lower fixing plates are sleeved in the upper guiding slots and the lower guiding slot, respectively, for connecting the two fast-assembling rails through the rail connection piece. An inner side wall of the lower fixing plates has a guiding recess, and the rail connection piece is provided with a guiding protruding block cooperating with the guiding recess correspondingly; and the guiding protruding block is located in the lower guiding slot.

As a preferred solution of the present invention, left division plates which are symmetrical about a horizontal axis and right division plates which are symmetrical about the horizontal axis may be disposed in the fast-assembling rails; and the left division plates and the right division plates may be respectively arranged at two sides of the groove and be vertically arranged in the fast-assembling rails, and the left division plates and the right division plates may divide the groove to a left belt cavity, a sliding component cavity and a right belt cavity in turn.

As a preferred solution of the present invention, a plurality of protruding parts may be evenly arranged at inner side walls of the left belt cavity and the right belt cavity near the fast-assembling rails; and the protruding part may extend horizontally along the fast-assembling rails.

As a preferred solution of the present invention, eight protruding parts may be arranged at the fast-assembling rails equidistantly, and the protruding parts may be fixedly connected with the fast-assembling rails and are formed integrally; and a distance between adjacent protruding parts may correspond to a length of the protruding part.

As a preferred solution of the present invention, a height of the guiding recess may be one third of a height of the lower fixing plate.

As a preferred solution of the present invention, both the guiding recess and the guiding protruding block may be arc transitions.

As a preferred solution of the present invention, the two adjacent fast-assembling rails and the rail connection piece may be fixedly connected through fastening pieces.

As a preferred solution of the present invention, each of the left division plates and the right division plates may be tapered with the width gradually narrower from bottom to top.

As a preferred solution of the present invention, the rail connection piece may be in a shape of a top plate and two parallel legs extending perpendicular from a bottom surface of the top plate, and two sides of the rail connection piece may be provided with threaded through holes matched with the fastening pieces.

As a preferred solution of the present invention, the rail connection piece and the fast-assembling rails may be made of an aluminum alloy material.

Beneficial effects of the present invention are:

1. An existing rail is divided into several segments, which reduces the size of a packing box as much as possible, facilitates transportation of the rail, and reduces a risk of damaging the rail; and the assembling of the fast-assembling rail is fast and convenient, the rails are firm and reliable after the connection is completed, the sliding component of the curtain runs smoothly in the rails, and noise is low.

2. The rails are symmetrical along the horizontal axis, so the transmission case connected with the rail can be installed in either forward or reverse directions. When the transmission case is installed in the reverse direction, a motor can be hidden inside a ceiling, and an overall construction of the curtain becomes more beautiful without the protruding motor.

3. At the same time, the guiding recess is formed at the inner side wall of the lower fixing plates, the rail connection piece is provided with the guiding protruding block cooperating with the guiding recess, and through the connection and cooperating between the guiding recess and the guiding protruding block, the connection of the curtain rails is more firm, stability is better, and the usage safety is ensured.

Figure 1:
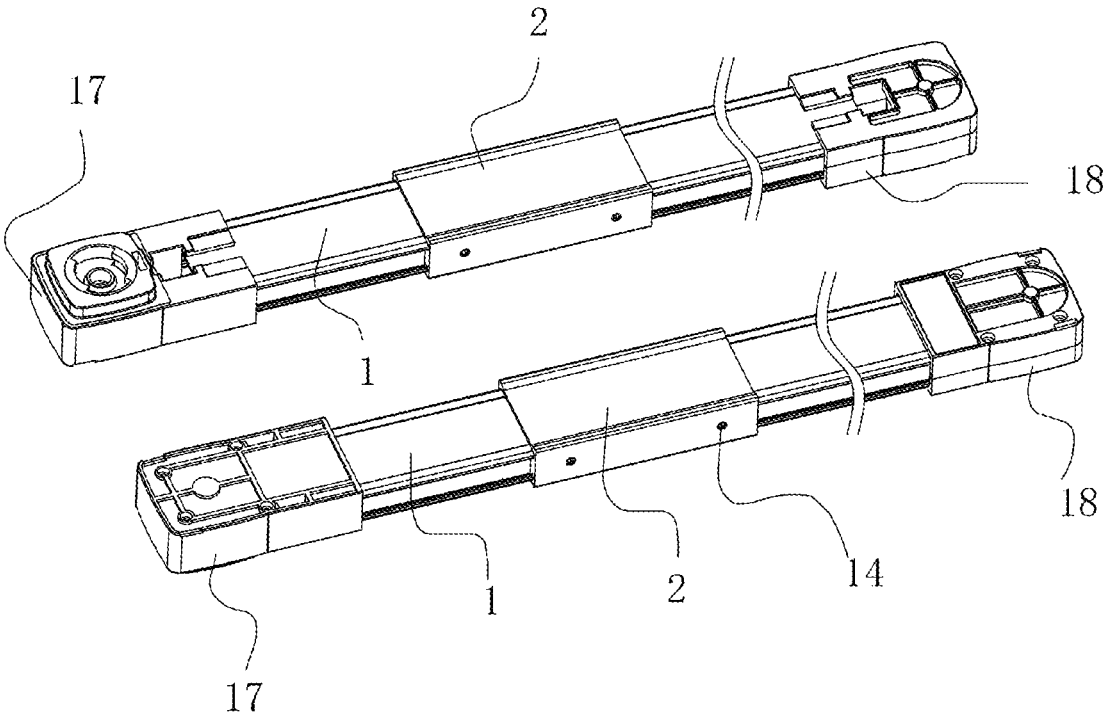
FIG. 1 is a schematic diagram of forward and reverse installations of a rail according to the present invention.

Reference numerals in the figures: fast-assembling rail 1, rail connection piece 2, groove 3, upper fixing plates 4, lower fixing plates 5, guiding recess 5-1, connection slot 6, connection block 7, left division plates 8, right division plates 9, left belt cavity 10, sliding component cavity 11, right belt cavity 12, protruding part 13, fastening piece 14, upper guiding slots 15, lower guiding slots 16, guiding protruding block 16-1, main transmission case 17, and side transmission case 18.

DETAILED DESCRIPTION OF THE INVENTION

The embodiment of the present invention is described in detail below with reference to the accompanying drawings.

Figure 2:
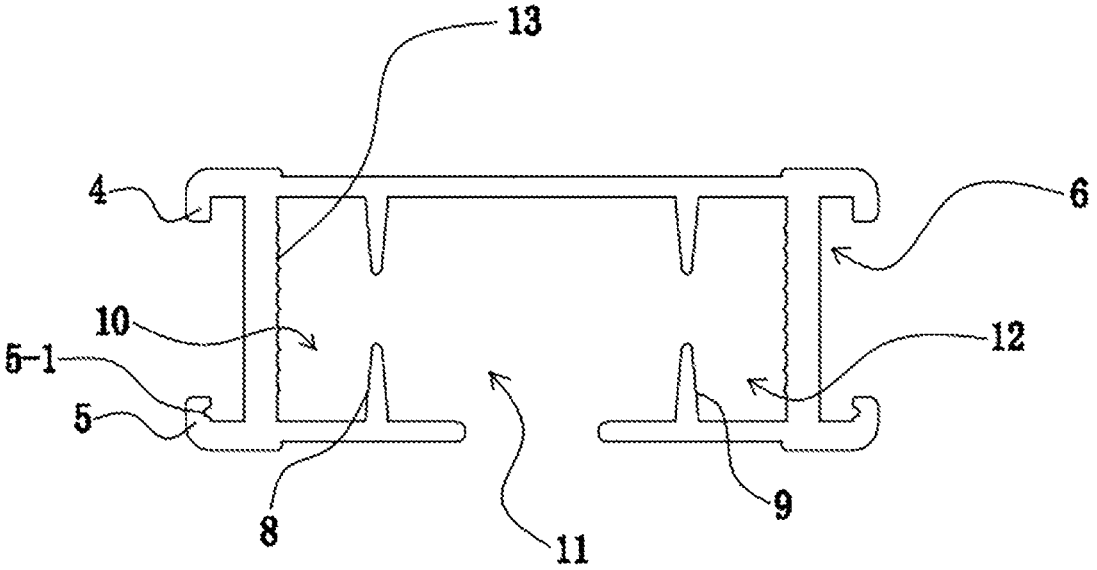
FIG. 2 is a schematic diagram of a cross section structure of a fast-assembling rail of the present invention.
Figure 3:
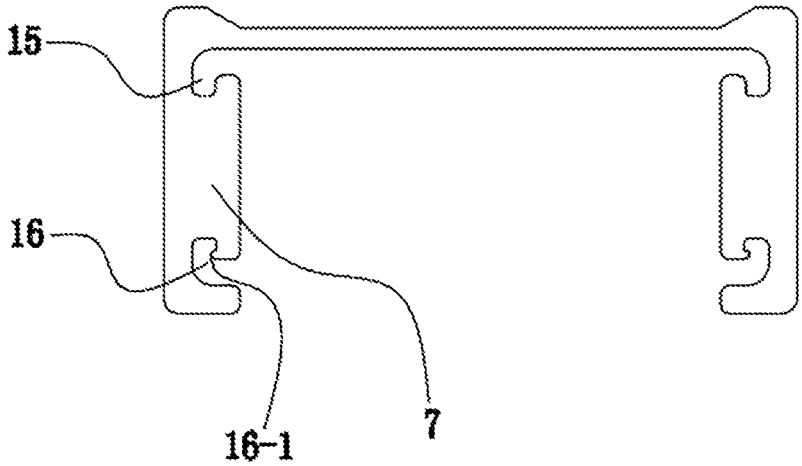
FIG. 3 is a schematic diagram of a cross section structure of a rail connection piece of the present invention.
Figure 4:
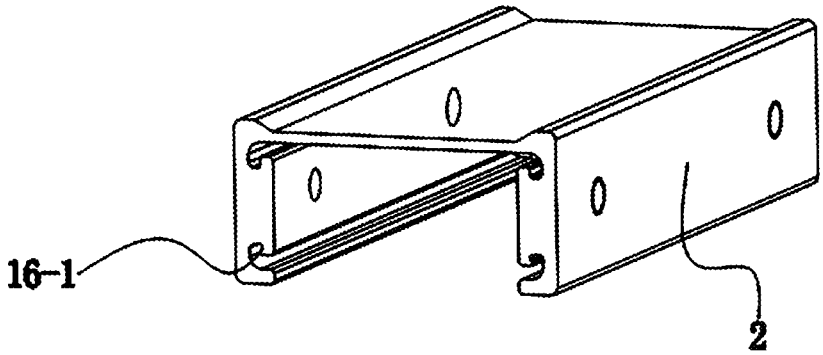
FIG. 4 is a structural schematic diagram of the rail connection piece of the present invention.
Figure 5:
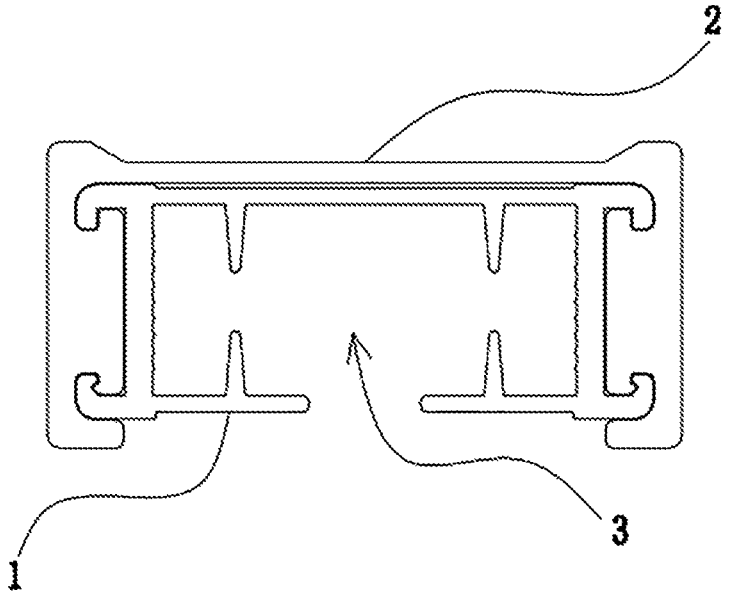
FIG. 5 is a schematic diagram of a cross section structure of a connection between the fast-assembling rails and the rail connection piece of the present invention.

The embodiment as shown in FIG. 1 to FIG. 5, an assembling curtain rail includes at least two corresponding fast-assembling rails 1 and a rail connection piece 2 used for connecting the two fast-assembling rails 1. A groove 3 with a downward opening for allowing a curtain sliding component to slide is formed at a middle part of the fast-assembling rails 1. Two sides of the fast-assembling rails 1 are provided with connection slots 6, and connection blocks 7 used for positioning and cooperating with the connection slots 6 are disposed in the rail connection piece 2 correspondingly. The rail connection piece 2 is detachably connected with the fast-assembling rails 1. The fast-assembling rails 1 are able to change the length of the curtain rail according to the need, flexibility is strong, and the fast-assembling rails 1 are divided into several segments, which reduces the size of a packing box as much as possible, facilitates transportation of the fast-assembling rails 1, and reduces a risk of damaging the fast-assembling rails 1. Through a detachable connection between the fast-assembling rails 1 and the rail connection piece 2, the disassembly and installation are fast and convenient, the rail is firm and reliable after the connection is completed, the sliding component of the curtain runs smoothly in the rail, and noise is low. In addition, the rail is symmetrical along a horizontal axis, so the transmission case connected with the rail can be installed in either a forward or reverse direction. When the transmission case is installed in the reverse direction, a motor can be hidden inside a ceiling, and an overall construction of the curtain becomes more beautiful without the protruding motor.

An upper end and a lower end of the two sides of the fast-assembling rails 1 are respectively connected with upper fixing plates 4 and lower fixing plates 5 which are symmetrical relative to each other; the upper fixing plates 4 and the lower fixing plates 5 are L-shaped; upper guiding slots 15 and lower guiding slots 16 which are symmetrical relative to each other are formed between a left end and a right end of an inner side wall of the rail connection piece 2 and the connection blocks 7. The upper fixing plates 4 and the lower fixing plates 5 are sleeved in the upper guiding slots 15 and the lower guiding slots 16, respectively, for connecting the two fast-assembling rails 1 through the rail connection piece 2; and the fastening between the two adjacent fast-assembling rails 1 and the rail connecting piece 2 is more convenient and fast by adopting the above-mentioned solution, which avoids shaking around, ensures the usage safety, and improves service efficiency at the same time.

A guiding recess 5-1 is formed at an inner side wall of each of the lower fixing plates 5, and the rail connection piece 2 is provided with a guiding protruding block 16-1 cooperating with the guiding recess 5-1 correspondingly; the guiding protruding block 16-1 is located in the lower guiding slots 16; and the inner side wall of the lower fixing plates forms the guiding recess, the rail connection piece is provided with the guiding protruding block cooperating with the guiding recess, and the connection of the curtain rail is more firm, stability is better, and the usage safety is ensured through the connection and cooperating between the guiding recess and the guiding protruding block.

A height of the guiding recess 5-1 is one third of a height of the lower fixing plate. Both the guiding recess 5-1 and the guiding protruding block 16-1 are formed with arc transitions. By adopting the above-mentioned solution, while the fast-assembling rails 1 and the rail connection piece 2 are firmly connected, the connection between the fast-assembling rails 1 and the rail connection piece 2 is more stable and convenient.

The rail connection piece 2 is in the shape of a top plate and two parallel legs extending perpendicular from a bottom surface of the top plate, which ensures that the overall construction of the curtain becomes more beautiful, and the strength and suffering stress of the rail connection piece 2 are more uniform to ensure the usage safety. Two adjacent fast-assembling rails 1 and the rail connection piece 2 are fixedly connected through fastening pieces 14. Two sides of the rail connection piece 2 are provided with threaded through holes matched with the fastening pieces 14. By disposing the fastening pieces 14 fixedly connecting two adjacent fast-assembling rails 1 and the rail connection piece 2, the rail is firm and reliable after the connection is completed, and the sliding component of the curtain runs smoothly in the rail. The number of the fastening pieces 14 is four. The fastening pieces are arranged symmetrically right and left, play a role in strengthening the connection, and are good for the stability of the stress.

Left division plates 8 which are symmetrical about a horizontal axis and right division plates 9 which are also symmetrical about the horizontal axis are disposed in the fast-assembling rails 1; each of the left division plates (8) and the right division plates (9) are tapered with the width gradually narrower from bottom to top; the left division plates 8 and the right division plates 9 are respectively arranged at two sides of the groove 3 and are vertically arranged in the fast-assembling rails 1, and the left division plates 8 and the right division plates 9 divide the groove 3 to a left belt cavity 10, a sliding component cavity 11 and a right belt cavity 12 in turn; a plurality of protruding parts 13 are evenly arranged at inner side walls of the left belt cavity 10 and the right belt cavity 12 near the fast-assembling rails 1; and the protruding part 13 extends horizontally along the fast-assembling rails 1. The function of the disposing is that the protruding part 13 makes a contact surface between the sliding component of the curtain and the inside of the fast-assembling rails 1 smaller, and has effects of shock absorption and noise reduction.

A cross section of the protruding part 13 is triangular, semicircular or trapezoidal and so on; and disposing a plurality of protruding parts 13 is to reduce friction between the belt buckle and the inner wall of the fast-assembling rails 1 so as to make the sliding component of the curtain run smoothly in the rail and make the noise weak.

Eight protruding parts 13 are arranged at the fast-assembling rails 1 equidistantly, and the protruding parts 13 are fixedly connected with the fast-assembling rails 1 and are formed integrally; and a distance between adjacent protruding parts 13 corresponds to a length of the protruding part 13, which further increases the structure strength and connection firmness of the curtain rail.

The rail connection piece 2 and the fast-assembling rails 1 are made of an aluminum alloy material. Because of the small density, high strength and good corrosion resistance of the aluminum alloy, the service life of the curtain rail is prolonged.

A usage principle of the present invention is as follows: the connection slots 6 and connection blocks 7 at the two adjacent fast-assembling rails 1 cooperate with each other, the upper fixing plates 4 and the lower fixing plates 5 at both sides of the fast-assembling rails 1 buckle with the upper guiding slots 15 and the lower guiding slots 16 at both side of the rail connection piece 2 inside and outside, and the guiding recess 5-1 at the inner wall of the lower fixing plates 5 clamps correspondingly to the guiding protruding block 16-1 at the rail connection piece 2 at the same time to achieve a close connection between the two; after confirming the tight connection between the adjacent fast-assembling rails 1 and the rail connection piece 2, the fastening pieces 14 disposed at both sides of the rail connection piece 2 are fastened in advance, and finally a stable connection between the adjacent fast-assembling rails 1 and the rail connection piece 2 is achieved; after the installation is completed, the main transmission case 17 and the side transmission case 18 are installed at the left and right ends of the fast-assembling rails 1; and then parts such as the belt, the sliding component and so on are installed, and only the whole rail being stuck into a wall installation code after the assembly of the curtain rail is completed is needed, that is the final installation of the rail is completed, which is convenient, practical and safe.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

Although this application uses relative more reference numbers in the figures: fast-assembling rail 1, rail connection piece 2, groove 3, upper fixing plates 4, lower fixing plates 5, guiding recess 5-1, connection slot 6, connection block 7, left division plates 8, right division plates 9, left belt cavity 10, sliding component cavity 11, right belt cavity 12, protruding part 13, fastening piece 14, upper guiding slots 15, lower guiding slots 16, guiding protruding block 16-1, main transmission case 17, side transmission case 18 and so on, it does not exclude the possibility of using other terms. The use of these terms is merely for the convenience of describing and explaining essence of the invention; and it is against the spirit of the invention to interpret them as any one of the additional limitations.

What is claimed is:

1. An assembling curtain rail, comprising at least two corresponding fast-assembling rails(1) and a rail connection piece (2) used for connecting the at least two fast-assembling rails (1); wherein a groove (3) with a downward opening for allowing a curtain sliding component to slide is formed at a middle part of each of the fast-assembling rails (1); two sides of each of the fast-assembling rails (1) are provided with connection slots (6), and connection blocks (7) used for positioning and cooperating with the connection slots (6) are disposed in the rail connection piece (2) correspondingly; the rail connection piece (2) is detachably connected with the at least two fast-assembling rails (1); an upper end and a lower end of the two sides of each of the fast-assembling rails (1) are respectively connected with upper fixing plates (4) and lower fixing plates (5) which are symmetrical relative to each other; the upper fixing plates (4) and the lower fixing plates (5) are L-shaped; upper guiding slots (15) and lower guiding slots (16) which are symmetrical relative to each other are formed between a left end and a right end of an inner side wall of the rail connection piece (2) and the connection blocks (7); the upper fixing plates (4) and the lower fixing plates (5) are sleeved in the upper guiding slots (15) and the lower guiding slots (16), respectively, for connecting the at least two fast-assembling rails (1) through the rail connection piece (2); an inner side wall of each of the lower fixing plates (5) has a guiding recess (5-1), and the rail connection piece (2) is provided with a guiding protruding block (16-1) cooperating with the guiding recess (5-1) correspondingly; and the guiding protruding block (16-1) is located in the lower guiding slots (16).

2. The assembling curtain rail according to claim 1, wherein left division plates (8) which are symmetrical about a horizontal axis and right division plates (9) which are symmetrical about the horizontal axis are disposed in each of the fast-assembling rails (1); and the left division plates (8) and the right division plates (9) are respectively arranged at two sides of the groove (3) and are vertically arranged in each of the fast-assembling rails (1), and the left division plates (8) and the right division plates (9) divide the groove (3) to a left belt cavity (10), a sliding component cavity (11) and a right belt cavity (12) in turn.

3. The assembling curtain rail according to claim 2, wherein a plurality of protruding parts (13) are evenly arranged at inner side walls of the left belt cavity (10) and the right belt cavity (12) near the fast-assembling rails (1); and the protruding parts (13) extend horizontally along the fast-assembling rails (1).

4. The assembling curtain rail according to claim 3, wherein eight protruding parts (13) are arranged at each of the fast-assembling rails (1) equidistantly, and the protruding parts (13) are fixedly connected with each of the fast-assembling rails (1) and are formed integrally; and a distance between adjacent protruding parts (13) corresponds to a length of each of the protruding parts (13).

5. The assembling curtain rail according to claim 1, wherein a height of the guiding recess (5-1) is one third of a height of the lower fixing plates (5).

6. The assembling curtain rail according to claim 5, wherein both the guiding recess (5-1) and the guiding protruding block (16-1) are formed with arc transitions.

7. The assembling curtain rail according to claim 4, wherein two adjacent fast-assembling rails (1) and the rail connection piece (2) are fixedly connected through fastening pieces (14).

8. The assembling curtain rail according to claim 2, wherein each of the left division plates (8) and the right division plates (9) are tapered with a width gradually narrower from a bottom of each of the plates to a top of each of the plates.

9. The assembling curtain rail according to claim 7, wherein the rail connection piece (2) is in a shape of a top plate and two parallel legs extending perpendicular from a bottom surface of the top plate, and two sides of the rail connection piece (2) are provided with threaded through holes matched with the fastening pieces (14).

10. The assembling curtain rail according to claim 9, wherein the rail connection piece (2) and each of the fast-assembling rails (1) are made of an aluminum alloy material.

* * * * *